US005409120A

United States Patent [19]

Miller et al.

[11] Patent Number: 5,409,120

[45] Date of Patent: Apr. 25, 1995

[54] SLOT WALL DISPLAY SUPPORT SYSTEM

[75] Inventors: Jim Miller, Mason; Scott Keighley; Kevin Shatzer, both of Cincinnati, all of Ohio

[73] Assignee: Hamilton Fixture Company, Hamilton, Ohio

[21] Appl. No.: 108,436

[22] Filed: Aug. 18, 1993

[51] Int. Cl.[6] ..... A47F 5/00

[52] U.S. Cl. ..... 211/87; 211/94; 52/588.1

[58] Field of Search ..... 211/94, 87, 189; 52/588.1, 38

[56] References Cited

U.S. PATENT DOCUMENTS

| | | | |
|---|---|---|---|
| 3,425,568 | 2/1969 | Albright . | |
| 4,323,163 | 4/1982 | Johns . | |
| 4,461,443 | 7/1984 | Dauman . | |
| 4,508,231 | 4/1985 | Honickman . | |
| 4,603,068 | 7/1986 | Hunter | 52/588.1 |
| 4,607,753 | 8/1986 | Radek . | |
| 4,618,192 | 10/1986 | Kelley . | |
| 4,629,076 | 12/1986 | Amstutz et al. . | |
| 4,694,965 | 9/1987 | Parnell | 211/87 |
| 4,726,554 | 2/1988 | Sorrell . | |
| 4,805,783 | 2/1989 | Mayer . | |
| 4,809,479 | 3/1989 | Tierno et al. . | |
| 4,825,601 | 5/1989 | Halverson | 211/87 |
| 4,961,295 | 10/1990 | Kosch et al. | 211/94 X |
| 4,968,171 | 11/1970 | Shell . | |
| 5,125,518 | 6/1992 | Ward . | |

*Primary Examiner*—Robert W. Gibson, Jr.
*Attorney, Agent, or Firm*—Wood, Herron & Evans

[57] ABSTRACT

A slot wall module (10) includes a plate (20) with forwardly extending rib pairs (24, 26). A channel (30) depends from one of the ribs (24) to provide hanging support for one type of display member (14). A slot space (40) defined between the rib pair (24, 26), in cooperation with the channel (30), provides wedging support for another type of display member (12).

50 Claims, 1 Drawing Sheet

SLOT WALL DISPLAY SUPPORT SYSTEM

BACKGROUND OF THE INVENTION

1. Field of the Invention

The present invention relates to a slot wall system for supporting display members such as might be used in a store to display merchandise.

2. Description of Prior Art

A known slot wall display support system, such as the Alum-A-Wall system available from the assignee hereof, provides a plurality of slot wall modules each about five to six inches wide with tongue and groove arrangements on the top and bottom edges thereof by which to interfit several such modules together to define any desired height slot wall system. Each module is an extruded aluminum web formed to provide the appearance of an essentially fiat or smooth front surface having a number of parallel, horizontally disposed slots therein. Each slot extends in from the face and up behind a portion of the fiat lace to define a C-shape in cross section. The slot receives a slot wall attachment display member therein (such as a Z-bar attachment) whereby to wedgingly hold the display member to the slot wall module. Several slot wall attachments may be thus inserted in various of the slots anywhere therealong such that a merchandiser has significant flexibility in setting up a display area.

The interfitted modules are connected to a wall or other supporting structure such as with screws inserted through the modules at each end of one or more of the slots. Trim strips held along the left and right side edges of the modules conceal the module edges and the screws.

While the above-described slot wall system provides many benefits, greater flexibility is desired. In particular, the above-described slot wall system is limited in that it is designed to essentially support only one type of display member, i.e., wedged-in slot wall attachments.

SUMMARY OF THE INVENTION

The present invention provides a slot wall display support system wherein each module provides the added flexibility of supporting at least two different types of display members thus providing even greater flexibility to merchandisers. To this end, and in accordance with the principles of the present invention, each module is formed as a plate with at least two ribs extending in parallel and normal from the plate with a channel depending from and along the distal end of one of the ribs. The ribs are spaced apart such that a slot is defined therebetween which extends in towards the plate between the bottom of the channel and the other rib and up behind the channel communicating with the groove. The slot provides wedging support for one type of display member such as a Z-bar attachment or other slot wall attachments as was possible with the Alum-A-Wall product. The channel, on the other hand, provides hanging support for another type of display member such as earring display cards.

By virtue of the foregoing there is thus provided a slot wall display support system with many of the benefits of prior slot wall systems but with the added flexibility of being able to support multiple types of display members. These and other objects and advantages of the present invention shall be made apparent from the accompanying drawings and description thereof.

BRIEF DESCRIPTION OF THE DRAWINGS

The accompanying drawings, which are incorporated in and constitute a part of this specification, illustrate an embodiment of the invention and, together with a general description of the invention given above, and the detailed description given below, serve to explain the principles of the invention.

DETAILED DESCRIPTION OF THE DRAWINGS

Figure 2:
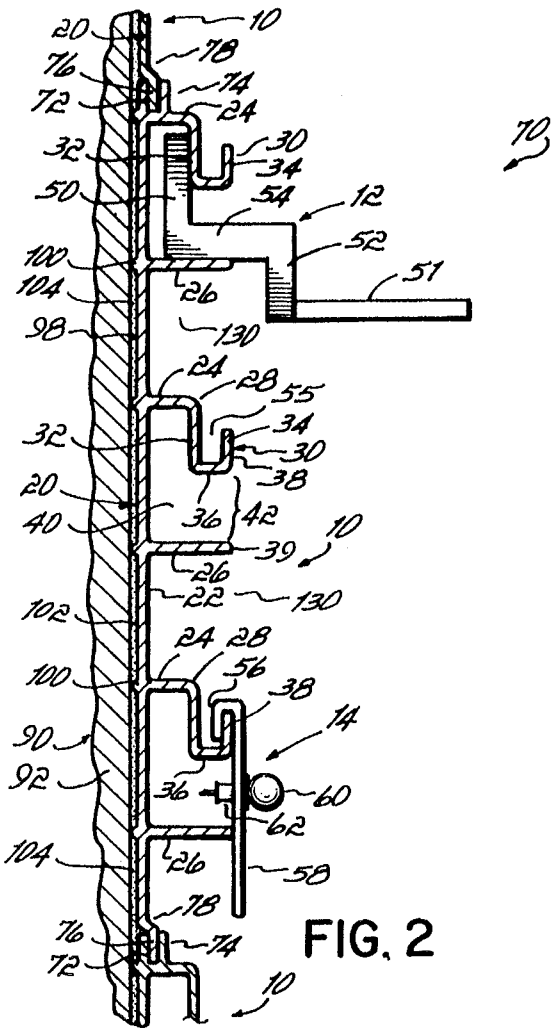
FIG. 2 is a cross-sectional view of a plurality of the slot wall display support modules of FIG. 1 shown attached to a display support wall.
Figure 1:
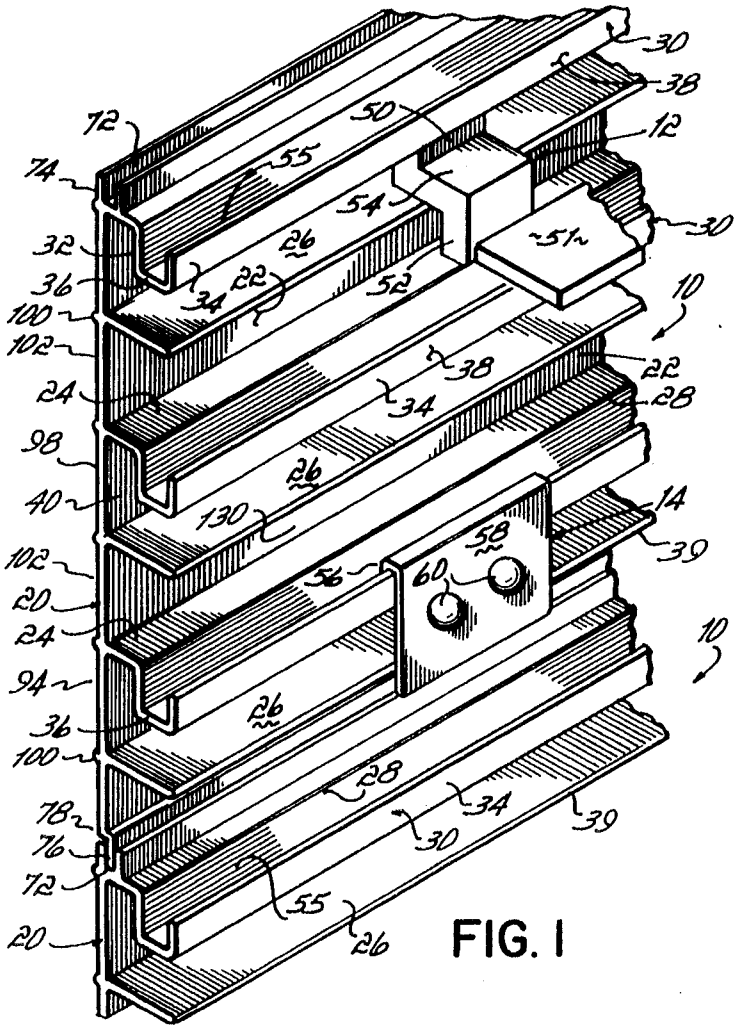
FIG. 1 is a perspective view of a slot wall display support module in accordance with the principles of the present invention.

With reference to Figures, there is shown a slot wall display support module 10 in accordance with the principles of the present invention for wedgingly supporting one type of display member 12 such as a Z-bar slot wall attachment and hangingly supporting another type of display member 14 such as an earring card display. Module 10 is desirably an extruded aluminum (type 6063T5) member comprised of a 0.05 inch thick rigid web or plate 20 which will generally be held in an upright orientation in use as seen in FIG. 2. Extending about 0.225 inches from, and normal to, planar front face 22 of plate 20 are a plurality of 0.05 inch thick parallel first ribs 24 on 1.5 inch centers. Ribs 24 are generally disposed horizontally when plate 20 is held in an upright orientation.

Also extending about 0.5 inch from, and normal to, face 22 are a plurality of parallel 0.05 inch thick second ribs or standoffs 26. Ribs 26 are also on 1.5 inch centers and spaced approximately equidistant from and parallel to first ribs 24. Formed along distal end 28 of each first rib 24 is a depending channel 30 which extends along the length of distal end 28 to define a U-shaped cross-section. Each channel 30 has a back wall 32 extending about 0.75 inch downwardly from distal end 28 parallel to plate face 22 and a front wall 34 extending upwardly about 0.19 inch and parallel to the back wall 32 with a bite wall portion 36 extending therebetween parallel to an adjacent second rib 26. The distal ends or tips 39 of standoff ribs 26 define a plane which generally contains the outer surface 38 of channel front walls 34, i.e., they are generally coplanar. Webs 32, 34 and 36 are each about 0.05 inch thick.

Each rib 24 and the next lower, adjacent rib 26 define a rib pair having a slot space 40 therebetween. Each slot 40 extends in towards plate face 22 from 0.375 inch opening at 42 below bite wall 36 and adjacent wall 32 to define an L-shaped cross-section to wedgingly receive the slot wall attachment 12.

Z-bar attachment 12 includes a first upwardly extending leg 50 sized to fit between rib pair 24, 26, and a second, downwardly extending leg 52 with a shelf 54 therebetween. Leg 50 fits into slot opening 42 and Z-bar 12 is up-ended so leg 50 fits back and up into slot 40 behind wall 32 such that leg 50 bears against wall 32 and/or shelf 54 bears against rib 26 to thus wedgingly hold display member 12 to module 10. Display apparatus such as a tray 51 is mounted to one or more members 12 as is conventional. Other display members of this first type may similarly be wedgingly supported to module 10 such as slot wall hooks, slot wall face-outs or other slot wall attachments (not shown).

Module 10, in accordance with the principles of the present invention, may also, simultaneously hangingly support a different type of display member such as display card 14 which hangs from module 10 rather than being wedged thereto. To this end, each channel 30 defines an upwardly opening groove 55. Lip 56 of card 14 is received in groove 55 such that display wall 58 connected to lip 56 extends down in front of opening 42 and rests against distal end 39 of adjacent, lower standoff 26. Any displayed items, e.g., earrings 60, are normally held to wall 58 such that any back side projections 62 (e.g., earring posts or the like) extend into slot 40 via opening 42 as seen in FIG. 2.

By virtue of pairs of ribs 24, 26 and depending channel 30, module 10 provides support for at least two very different types of support members 12 and 14, one of which hangs from module 10, for example, and the other of which engages interiorly of module 10 to be wedged therein.

In order to interfit a plurality of modules 10 together to define a slot wall system 70 as seen in FIG. 2, each module 10 is provided with a 0.07 inch wide groove 72 extending along the top edge 74 thereof (adjacent the uppermost rib 24) and a 0.06 inch offset tongue 76 extending along the bottom edge 78 thereof (spaced below the bottommost rib 26). Tongue 76 is 0.05 inch thick and designed to fit within a groove 72 of an adjacent module 10 to hold two modules together with their plate faces 22 coplanar thus providing a slot wall system 70 of any desired height. Tongues 76 could have a notch or lip to receive a tang (both not shown) on an edge of groove 72 to lock two plates 20 together.

Preferably, modules 10 are held to a supporting structure 90 such as a supporting display wall 92 as seen in FIG. 2. To this end, one or more screws or nails (not shown) could be inserted through plate 12 adjacent the opposed lateral ends 94 (only one shown) of modules 10 by being inserted directly through slot opening 42 and plate 20 and into supporting structure wall 92 and trim plates (not shown) added to cover ends 94, 96 and the screws to hide them from view. The same trim plates and related support pieces as used for the Alum-A-Wall product may be used with modules 10. In the support 90 of FIG. 2, modules 10 are adhesively or otherwise held to wall 92. To this end, the back face 98 of plate 20 is also planar and includes a plurality of longitudinally extending 0.0025 thick beads 100 aligned with each rib 24, 26. Beads 100 define a plane parallel to face 98 to match up to wall 92 with shallow channels 102 therebetween to allow flow of the adhesive 104 for best adherence as depicted in FIG. 2.

In use, one or more slot walls 10 are mounted to support 90 with the tongue 76 of one module in the groove of the module therebelow. Adhesive 104 (such as liquid nails) is applied to back face 98 and modules 10 held against wall 92 of display 90. Trim plates may be added as desired. To display objects, one or more hanging-type display members may be suspended from channel(s) 30 and one or more wedging-type display members may be inserted into slot(s) 40. Thus, multiple types of display members may be supported by module 10 providing a flexible slot wall system.

While the present invention has been illustrated by description of an embodiment of the invention and while the illustrative embodiment has been described in considerable detail, it is not intended to restrict or in any way limit the scope of the appended claims to such detail. Additional advantages and modifications will readily appear to those skilled in the art. For example, the webs of plate 20 and any of ribs 24 or 26 or walls 32, 34, or 36 need not be solid or imperforate throughout as shown, but could have apertures therethrough. Further, and as will be appreciated from the Figures, an additional slot space 130 is defined between a rib 24 and the next, upper adjacent standoff rib 26 which may be used to support one of members 12 or 14 or a yet third type of display member (not shown). The invention in its broader aspects is therefore not limited to the specific details, representative apparatus and methods, and illustrative examples shown and described. Accordingly, departures may be made from such details without departing from the spirit or scope of the general inventive concept.

Having described the invention, what is claimed is:

1. A slot wall for supporting at least two different types of display members comprising:

a plate to be held in a generally upright orientation;

first rib extending normally from the plate;

a first channel member depending from a distal end of the first rib, the channel member opening upwardly when the plate is held in a generally upright orientation whereby to provide hanging support for a display member of a first type;

a second rib extending normally from the plate and spaced from the first rib and first channel whereby to define a slot space therebetween;

a third rib extending normally from the plate and spaced laterally below the second rib when the plate is held in a generally upright orientation; and a second channel member depending from a distal end of the third rib, the second channel member also opening upwardly when the plate is held in a generally upright orientation whereby to provide additional hanging support for a display member of said first type.

2. The slot wall of claim 1 wherein the first rib and depending channel member are spaced laterally above the second rib when the plate is held in a generally upright orientation whereby the defined slot space provides wedging support for a display member of a second, different type.

3. The slot wall of claim 1 wherein the plate has a first edge and a second edge defining upper and lower edges of the plate when the plate is held in a generally upright orientation, one of the edges having a groove and another of the edges having a tongue sized and positioned to be received in the groove of another, similar slot wall to hold the plates thereof in generally coplanar relationship to define a larger combined slot wall system.

4. The slot wall of claim 1 wherein the plate, ribs and channels are formed as a single extruded member.

5. The slot wall of claim 4 wherein the extruded member is comprised of aluminum.

6. The slot wall of claim 1 wherein the channels are U-shaped in cross-section.

7. The slot wall of claim 1 wherein the ribs all extend from a front face of the plate, the slot wall further comprising a plurality of beads formed on a back face of the plate whereby to facilitate adhesively adhering the slot wall to a support wall.

8. The slot wall of claim 1 wherein an outer wall of one of the channels and a distal end of the second rib are in generally one plane.

9. The slot wall of claim 1 wherein the plate is rigid.

10. A slot wall for supporting different types of display members comprising:

a plate to be held in a generally upright orientation;

a plurality of first ribs extending in parallel and normally from the plate;

a plurality of channels each having a U-shaped cross-section, each channel depending from and along a distal end of a respective one of the first ribs and opening upwardly when the plate is held in a generally upright orientation whereby to provide a plurality of hanging supports for a display member of a first type;

a plurality of second ribs extending in parallel and normally from the plate, the first and second ribs extending in alternate succession from the plate whereby to define slot spaces therebetween wherein the slot space between at least one of the first ribs and an adjacent, lower second rib provides wedging support for a display member of a second, different type.

11. The slot wall of claim 10 wherein the plate, ribs and channels are formed as a single extruded member.

12. The slot wall of claim 11 wherein the extruded member is comprised of aluminum.

13. The slot wall of claim 10 wherein the ribs all extend from a front face of the plate, the slot wall further comprising a plurality of beads formed on a back face of the plate whereby to facilitate adhesively adhering the slot wall to a support wall.

14. The slot wall of claim 10 wherein an outer wall of the channels and a distal end of the second ribs are generally coplanar.

15. The slot wall of claim 10 wherein the plate is rigid.

16. The slot wall of claim 10 wherein the plate has a first edge and a second edge defining upper and lower edges of the plate when the plate is held in a generally upright orientation, one of the edges having a groove and another of the edges having a tongue sized and positioned to be received in the groove of another, similar slot wall to hold the plates thereof in generally coplanar relationship to define a larger combined slot wall system.

17. A slot wall for supporting at least two different types of display members comprising:

a plate to be held in a generally upright orientation;

a first rib extending normally from the plate;

a channel member depending from a distal end of the first rib, the channel member opening upwardly when the plate is held in a generally upright orientation whereby to provide hanging support for a display member of a first type;

a second rib extending normally from the plate and spaced from the first rib and channel whereby to define a slot space therebetween; and a third rib extending normally from the plate and spaced laterally above the first rib and depending channel member when the plate is held in a generally upright orientation.

18. The slot wall of claim 17 wherein the first rib and depending channel member are speced laterally above the second rib when the plate is held in a generally upright orientation whereby the defined slot space provides wedging support for a display member of a second, different type.

19. The slot wall of claim 17 wherein the plate has a first edge and a second edge defining upper and lower edges of the plate when the plate is held in a generally upright orientation, one of the edges having a groove and another of the edges having a tongue sized and positioned to be received in the groove of another, similar slot wall to hold the plates thereof in generally coplanar relationship to define a larger combined slot wall system.

20. The slot wall of claim 17 wherein the plate, ribs and channel are formed as a single extruded member.

21. The slot wall of claim 20 wherein the extruded member is comprised of aluminum.

22. The slot wall of claim 17 wherein the channel is U-shaped in cross-section.

23. The slot wall of claim 17 wherein the ribs all extend from a front face of the plate, the slot wall further comprising a plurality of beads formed on a back face of the plate whereby to facilitate adhesively adhering the slot wall to a support wall.

24. The slot wall of claim 17 wherein an outer wall of the channel and a distal end of one of the ribs are in generally one plane.

25. The slot wall of claim 17 wherein the plate is rigid.

26. A slot wall for supporting at least two different types of display members comprising:

a plate to be held in a generally upright orientation;

a first rib extending normally from the plate;

a channel member depending from a distal end of the first rib, the channel member opening upwardly when the plate is held in a generally upright orientation whereby to provide hanging support for a display member of a first type;

a second rib extending normally from the plate and spaced from the first rib and channel whereby to define a slot space therebetween, wherein the second rib is spaced laterally above the first rib and depending channel member when the plate is held in a generally upright orientation.

27. The slot wall of claim 26 further comprising:

a third rib extending normally from the plate and spaced laterally above the second rib when the plate is held in a generally upright orientation; and a second channel member depending from a distal end of the third rib, the second channel member also opening upwardly when the plate is held in a generally upright orientation whereby to provide an additional hanging support for a display member of said first type, and whereby to define a slot space between the second and third ribs to provide wedging support for a display member of a second, different type.

28. The slot wall of claim 26 further comprising a third rib extending normally from the plate and spaced laterally below the first rib and depending channel member when the plate is held in a generally upright orientation whereby to define a slot space therebetween to provide wedging support for a display member of a second, different type.

29. The slot wall of claim 26 wherein the plate has a first edge and a second edge defining upper and lower edges of the plate when the plate is held in a generally upright orientation, one of the edges having a groove and another of the edges having a tongue sized and positioned to be received in the groove of another, similar slot wall to hold the plates thereof in generally coplanar relationship to define a larger combined slot wall system.

30. The slot wall of claim 26 wherein the plate, ribs and channel are formed as a single extruded member.

31. The slot wall of claim 30 wherein the extruded member is comprised of aluminum.

32. The slot wall of claim 26 wherein the channel is U-shaped in cross-section.

33. The slot wall of claim 26 wherein the ribs all extend from a front face of the plate, the slot wall further comprising a plurality of beads formed on a back face of the plate whereby to facilitate adhesively adhering the slot wall to a support wall.

34. The slot wall of claim 26 wherein an outer wall of the channel and a distal end of the second rib are in generally one plane.

35. The slot wall of claim 26 wherein the plate is rigid.

36. A slot wall for supporting at least two different types of display members comprising:

a plate to be held in a generally upright orientation;

a first rib extending normally from the plate;

a channel member depending from a distal end of the first rib, the channel member opening upwardly when the plate is held in a generally upright orientation whereby to provide hanging support for a display member of a first type;

a second rib extending normally from the plate and spaced from the first rib and channel whereby to define a slot space therebetween, wherein the plate has a first edge and a second edge defining upper and lower edges of the plate when the plate is held in a generally upright orientation, one of the edges having a groove and another of the edges having a tongue sized and positioned to be received in the groove of another, similar slot wall to hold the plates thereof in generally coplanar relationship to define a larger combined slot wall system.

37. The slot wall of claim 36 wherein the first rib and depending channel member are spaced laterally above the second rib when the plate is held in a generally upright orientation whereby the defined slot space provides wedging support for a display member of a second, different type.

38. The slot wall of claim 36 wherein the plate, ribs, channel, groove and tongue are formed as a single extruded member.

39. The slot wall of claim 38 wherein the extruded member is comprised of aluminum.

40. The slot wall of claim 36 wherein the channel is U-shaped in cross-section.

41. The slot wall of claim 36 wherein the ribs all extend from a front face of the plate, the slot wall further comprising a plurality of beads formed on a back face of the plate whereby to facilitate adhesively adhering the slot wall to a support wall.

42. The slot wall of claim 36 wherein an outer wall of the channel and a distal end of the second rib are in generally one plane.

43. The slot wall of claim 36 wherein the plate is rigid.

44. A slot wall for supporting at least two different types of display members comprising:

a plate to be held in a generally upright orientation;

a first rib extending normally from the plate;

a channel member depending from a distal end of the first rib, the channel member opening upwardly when the plate is held in a generally upright orientation whereby to provide hanging support for a display member of a first type;

a second rib extending normally from the plate and spaced from the first rib and channel whereby to define a slot space therebetween, wherein the ribs all extend from a front face of the plate, the slot wall further comprising a plurality of beads formed on a back face of the plate whereby to facilitate adhesively adhering the slot wall to a support wall.

45. The slot wall of claim 44 wherein the first rib and depending channel member are spaced laterally above the second rib when the plate is held in a generally upright orientation whereby the defined slot space provides wedging support for a display member of a second, different type.

46. The slot wall of claim 44 wherein the plate, ribs, channel and beads are formed as a single extruded member.

47. The slot wall of claim 46 wherein the extruded member is comprised of aluminum.

48. The slot wall of claim 44 wherein the channel is U-shaped in cross-section.

49. The slot wall of claim 44 wherein an outer wall of the channel and a distal end of the second rib are in generally one plane.

50. The slot wall of claim 44 wherein the plate is rigid.

* * * * *